US005772568A

United States Patent [19]

Chen

[11] Patent Number: 5,772,568

[45] Date of Patent: Jun. 30, 1998

[54] CARTON FLAP FOLDING AND SEALING MACHINE

[75] Inventor: Tuan-Mei Chiu Chen, Chia-Yi Hsien, Taiwan

[73] Assignee: Tien Heng Machinery Co., Ltd., Chia-Yi Hsien, Taiwan

[21] Appl. No.: 877,179

[22] Filed: Jun. 17, 1997

[51] Int. Cl.[6] ..... B31B 1/72

[52] U.S. Cl. ..... 493/116; 493/25; 493/117; 493/183

[58] Field of Search ..... 493/13, 14, 23, 493/17, 18, 25, 34, 51, 69, 70, 79, 80, 114, 115, 116, 121, 126, 127, 142, 151, 162, 183, 243, 245, 246, 248, 255, 260, 261, 262, 263, 264, 266, 267, 268, 309, 395, 397, 405, 458, 475, 476; 53/504, 377.2, 136.4

[56] References Cited

U.S. PATENT DOCUMENTS

| | | | |
|---|---|---|---|
| 3,885,372 | 5/1975 | Peres | 53/377.2 |
| 4,218,862 | 8/1980 | Marchetti | 53/377.2 |
| 4,262,469 | 4/1981 | Ooms | 53/136.4 |
| 4,422,282 | 12/1983 | Marchetti | 493/183 |
| 4,525,980 | 7/1985 | Ulrich | 53/377.2 |
| 4,642,966 | 2/1987 | Marchetti | 53/377.2 |
| 4,698,950 | 10/1987 | Marchetti | 53/377.2 |
| 4,955,177 | 9/1990 | Lerner | 493/117 |
| 5,184,997 | 2/1993 | James | 493/117 |
| 5,480,371 | 1/1996 | Morita | 493/117 |
| 5,538,491 | 7/1996 | Owen | 493/70 |

*Primary Examiner*—Joseph J. Hail, III
*Assistant Examiner*—Christopher W. Day
*Attorney, Agent, or Firm*—Rosenberg, Klein & Bilker

[57] ABSTRACT

A carton flap folding and sealing machine includes a separator, a conveyor, a first folding device, a second folding device, a third folding device and a sealing device. Cartons are orderly position by the separator and sent on the conveyor and moved forward to pass through the first folding device and the second folding device for a front flap and a rear flap folded down, and then through the third folding device for two side flaps folded down. Then cartons are moving into the sealing device to receive sealing operation without interruption, by means of two pairs of glue tapes disposed on a tape support frame and two pairs of upper bases and lower bases working alternately.

1 Claim, 14 Drawing Sheets

CARTON FLAP FOLDING AND SEALING MACHINE

BACKGROUND OF THE INVENTION

This invention concerns a carton flap folding and sealing machine, particularly continually performing to fold a front flap, a rear flap and two side flaps of a carton orderly moved from a separator and then to a conveyor for three folding devices for operating folding processes and then sealed by a sealing device without interruption.

Cartons are widely used nowadays for packing many kinds of commodities, and carton flap folding and sealing machines are also commonly used.

SUMMARY OF THE INVENTION

The purpose of the invention is to offer a kind of carton flap folding and sealing machine performing automatically folding and sealing operations without interruption.

One feature of the invention is a separator for orderly separate cartons to be folded and sealed to be sent on a conveyor.

Another feature of the invention is three folding devices disposed one after another for folding a front flap, a rear flap and two side flaps of a carton in order and to send it to a sealing device.

One more feature of the invention is the sealing device having two pairs of tape support frames and two pairs of upper bases and lower bases, which alternately operate to seal cartons with one pair of them immediately taking place of the other when one tape is used up. Then sealing process may not be interrupted even if a tape is used up.

BRIEF DESCRIPTION OF DRAWINGS

This invention will be better understood by referring to the accompanying drawings, wherein.

DESCRIPTION OF THE PREFERRED EMBODIMENT

Figure 1:
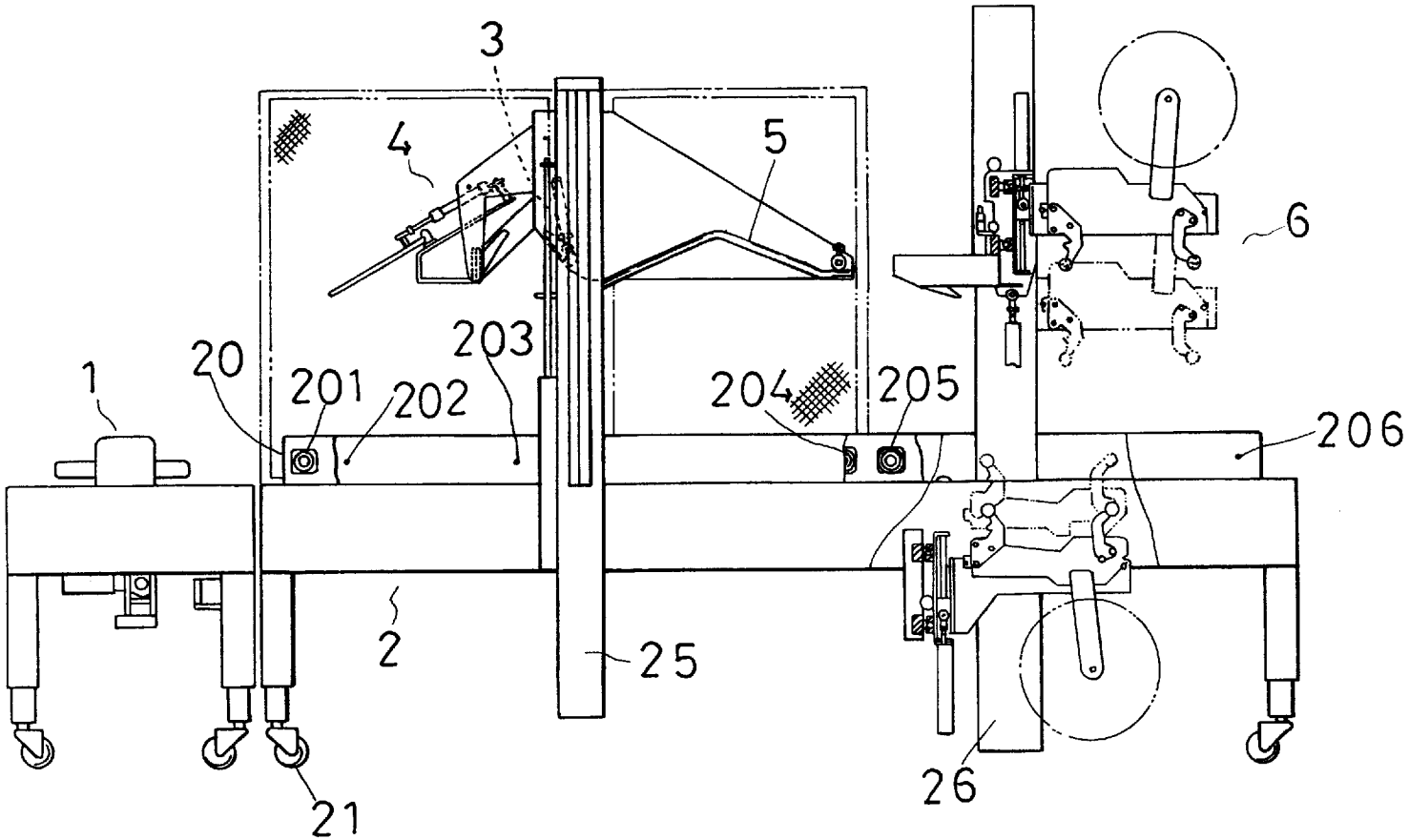
FIG. 1 is a side view of a carton flap folding and sealing machine in the present invention.
Figure 2:
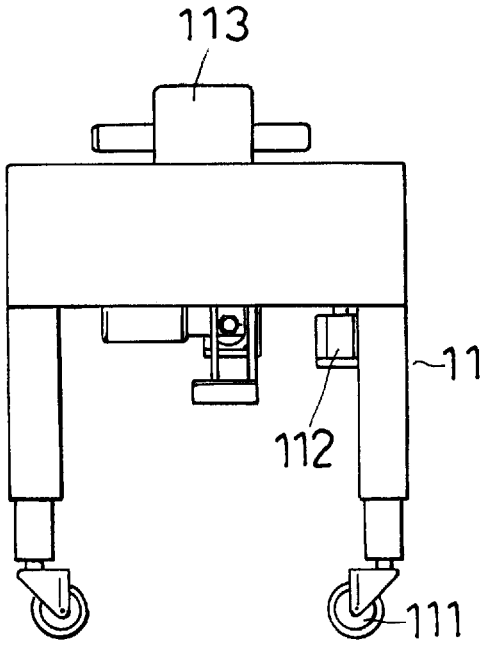
FIG. 2 is a side view of a separator in the present invention.
Figure 3:
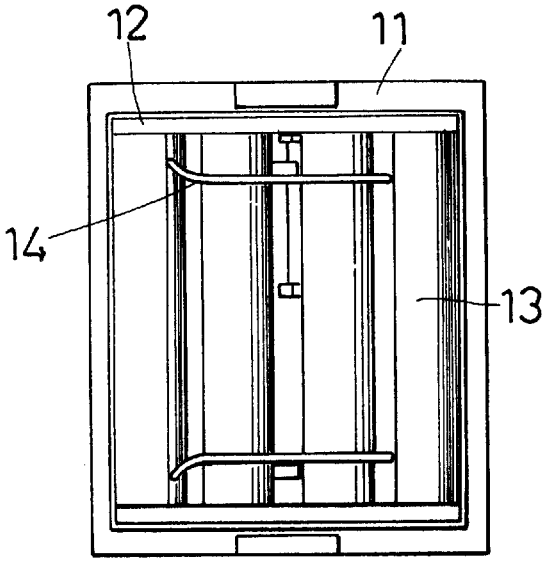
FIG. 3 is an upper view of the separator in the present invention.
Figure 4:
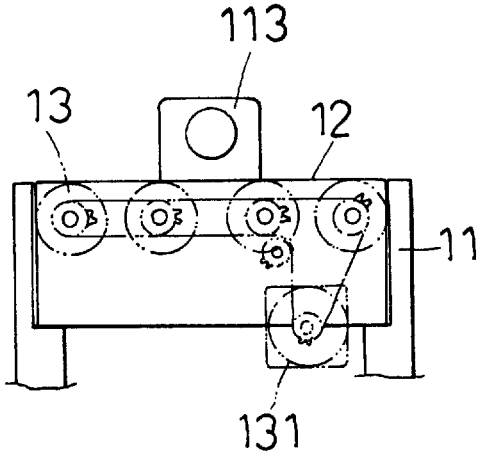
FIG. 4 is a side view of a motor of the separator in the present invention, showing it moving roller units.
Figure 5:
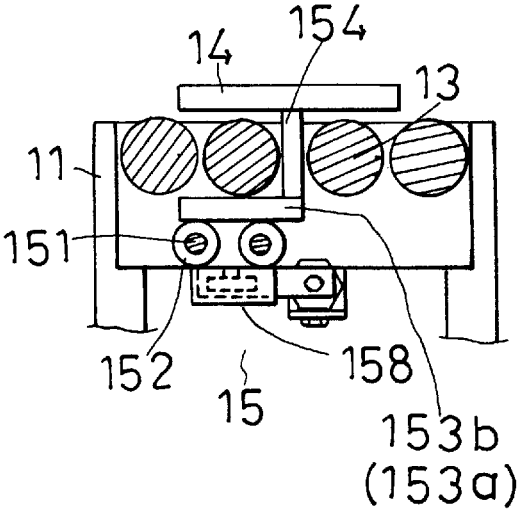
FIG. 5 is a side view of a transmitting device of the separator in the present invention.
Figure 6:
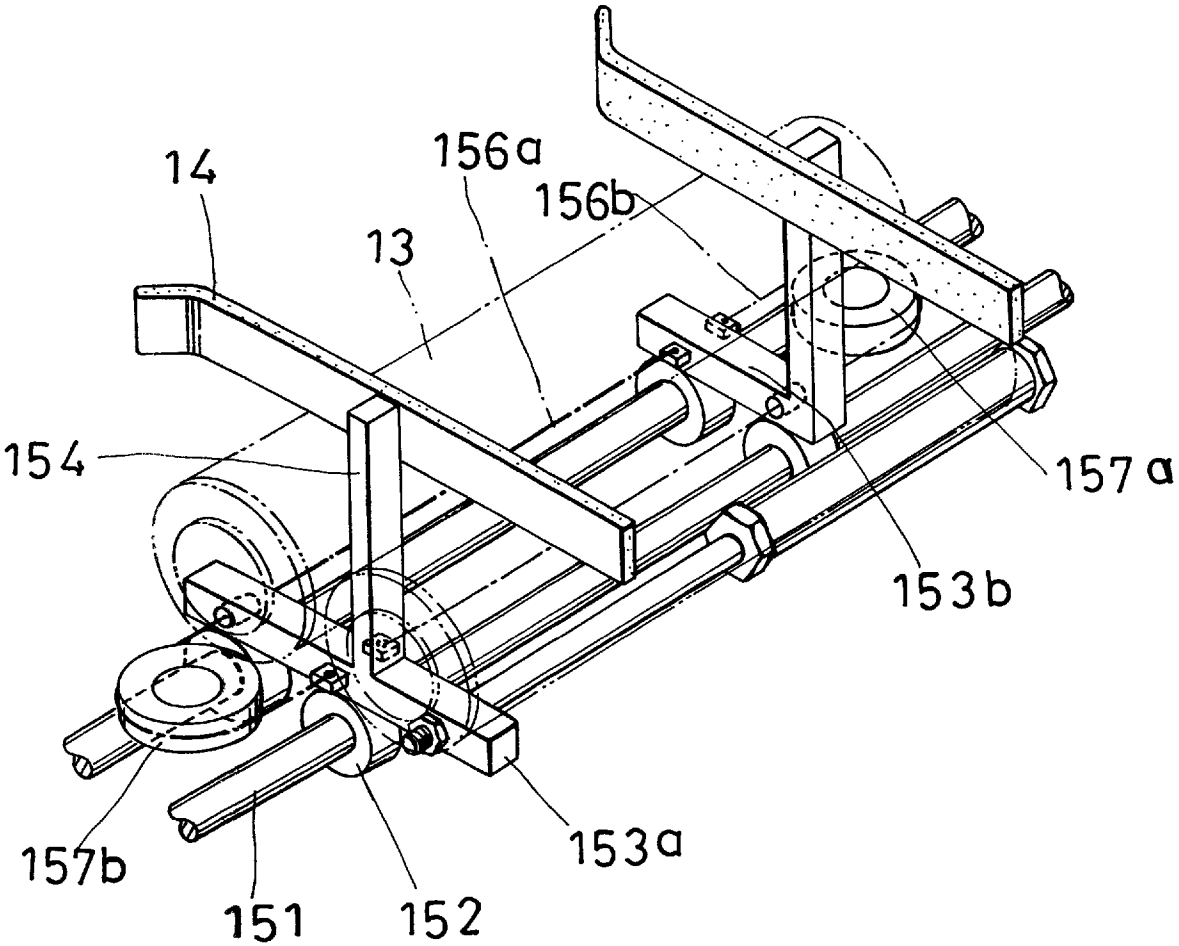
FIG. 6 is a perspective view of the transmitting device of the separator in the present invention.
Figure 7:
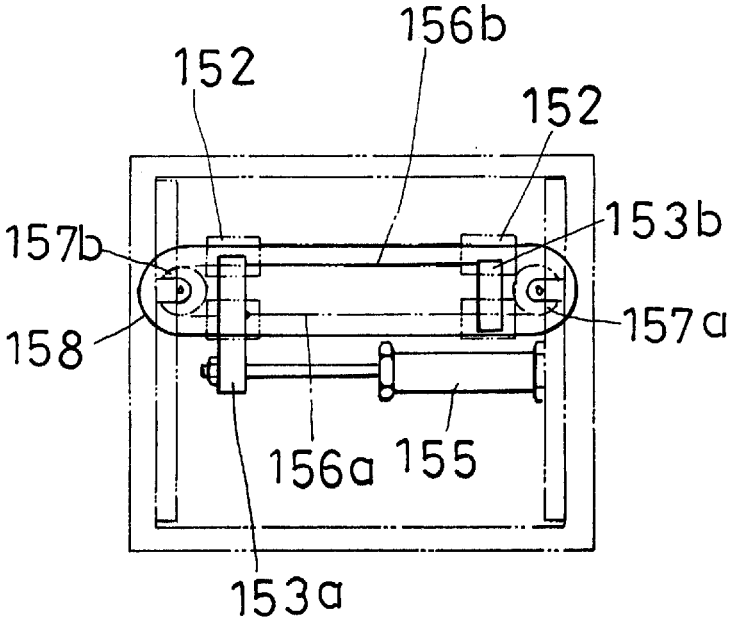
FIG. 7 is an upper view of the transmitting device of the separator in the present invention.
Figure 8:
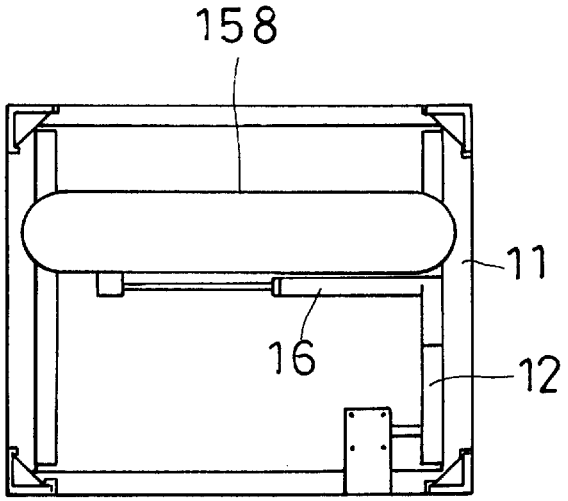
FIG. 8 is a bottom view of the transmitting device of the separator in the present invention.
Figure 11:
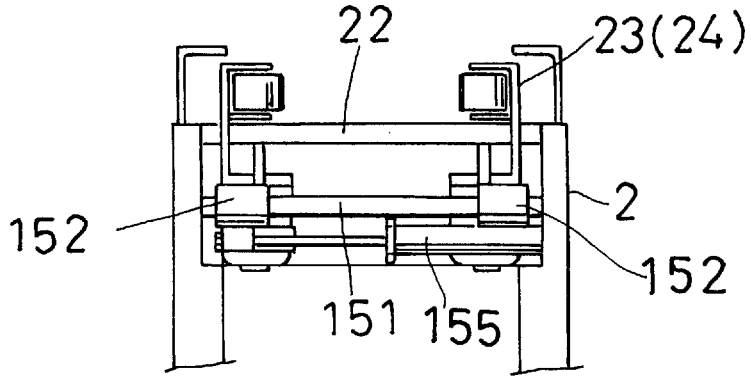
FIG. 11 is a front cross-sectional view of a conveyor in the present invention.

A preferred embodiment of a carton folding and sealing machine in the present invention, as shown in FIG. 1, includes a separator 1, a conveyor 2, a first folding device 3, a second folding device 4, a third folding device 5, and a sealing device 6 combined together.

The separator 1 consists of a position stand 11, a lift table 12, a roller unit 13, two clamp strips 14, 14, a transmitting device 15, and a linear scale 16.

The position stand 11 has four legs, casters 111 fixed at a bottom of each leg, a first air cylinder 112 fixed at a proper location for moving up and down the lift table 12 fixed on top of the position stand 11, and a sensor 113 fixed on an upper side edge of the stand.

The two clamp strips 14, 14 are disposed in parallel on the lift table 12 for clamping a carton between them, and moved by the transmitting unit 15. A plurality of rollers 13 are disposed between two side walls of the lift table 12, moved by a reduction motor 131.

The transmitting unit 15 has two slide bars 151, 151 between two side walls of the lift table 12, a slide block 152 fixed respectively on two ends of each bar 151, a fix plate 153*a*, 153*b* respectively connected on the slide blocks 152, 152, an upright support rod 154 disposed between two rollers 13, 13 and connected with the fix plate 153*a*, 153*b*, having its upper end fixed with each clamp strip 14. A second air cylinder 155 is fixed on a side wall, having its piston rod end fixed with the fix plate 153*a*. A first chain 156*a* is provided to have one end fixed on an outer side of the first fix plate 153*a*, extending around a first guide wheel 157*a* and having it through to the other side of the first fix plate 153*a* and then having its other end fixed on an inner side of a second fix plate 153*b*. A second chain 156*b* is provided to have its one end fixed on an outer side of the second fix plate 153*b*, extending around a second guide wheel 157*b* and having it through to the other side of the second fix plate 153*b* and then having the other end connected with an inner side of the first fix plate 153*a*. Then two sides of the transmitting device 15 are hidden with a cover 158. When the second air cylinder 155 operates, the first and the second fix flat plates 153*a*, 153*b* move nearer to or farther from each other at the same time.

A linear scale 16 is disposed on a side wall of the lift table 12 for measuring the width of a carton clamped between the two clamp strips 14, 14.

The conveyor 2, as shown in FIGS. 1, 11, 12 and 13, includes castors 21 at bottom ends, a plurality of rollers 22 on an upper side, two pairs of clamp strips 23, 24 in an upper portion and moved by the the transmitting device 15 of the separator 1.

Two front posts 25, 25 connected with an upper horizontal beam and two rear posts 26, 26 connected with an upper horizontal beam are disposed at two opposite sides of the conveyer 2, fixed with a first folding unit 3 and, a second folding unit 4. On a side edge of the conveyor 2 are fixed a first sensor 201, a second sensor 202, a third sensor 203, a fourth sensor 204, a fifth sensor 205, a sixth sensor 206 to correspond to the first, the second and the third folding unit 3, 4 and 5 for controlling those folding units in operation in folding flaps of a carton.

The first folding unit 3, as shown in FIGS. 14–17, includes a hollow case 30 fixed below the upper horizontal beam fixed between the two front posts 25. The hollow case 30 has a lower sloped guide surface 302, a sloped position surface 303 with a large curve extending down further from the sloped guide surface 302, and a hollow interior 301. A third air cylinder 31 is disposed in the hollow interior 301, having a piston rod end fixed with a revolving head 311, and a swing plate 32 pivotally connected with the revolving head 311, which swings to move a front flap of a carton.

Figure 18:
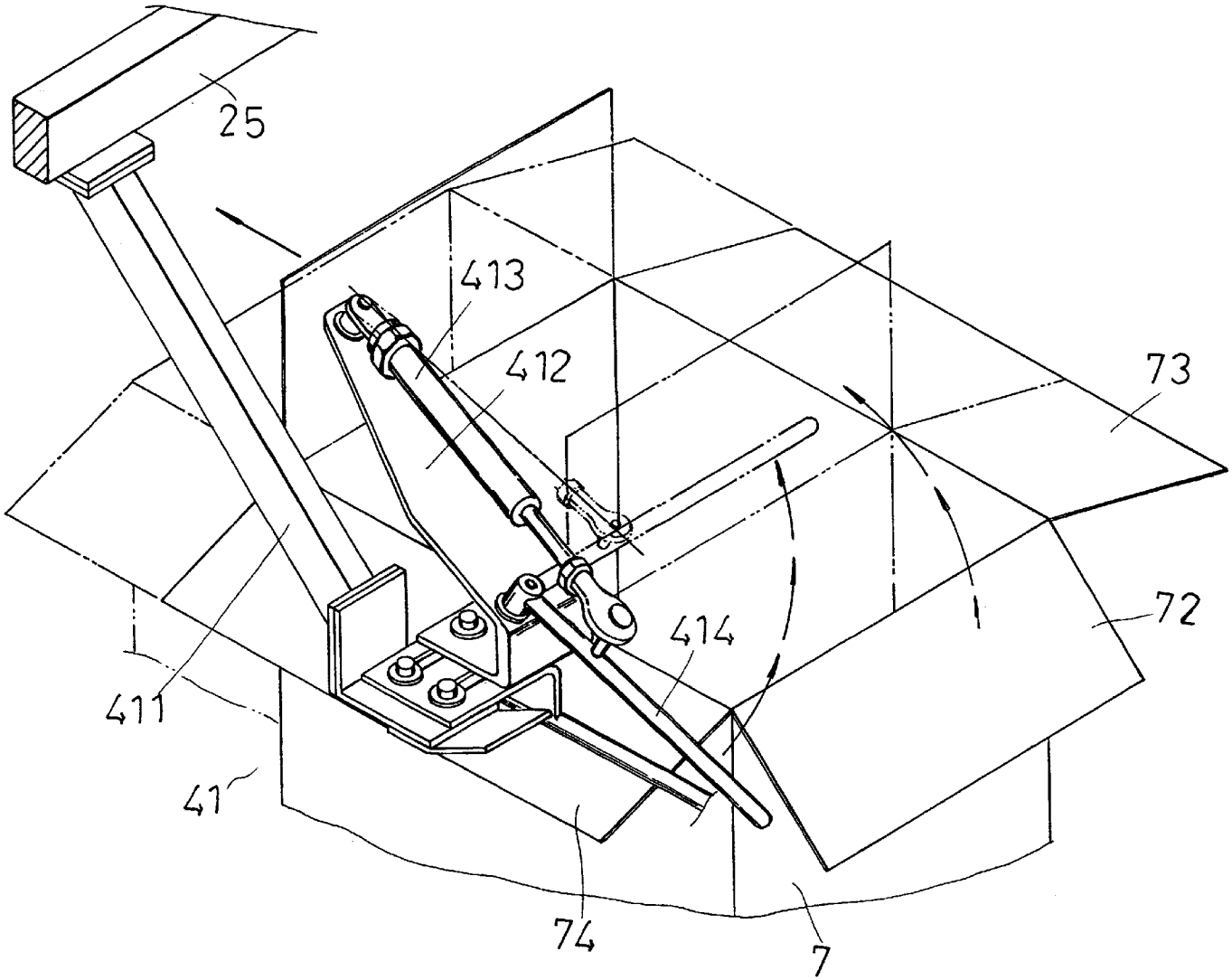
FIG. 18 is a perspective view of a first swing arm of the second folding device in the present invention.
Figure 19:
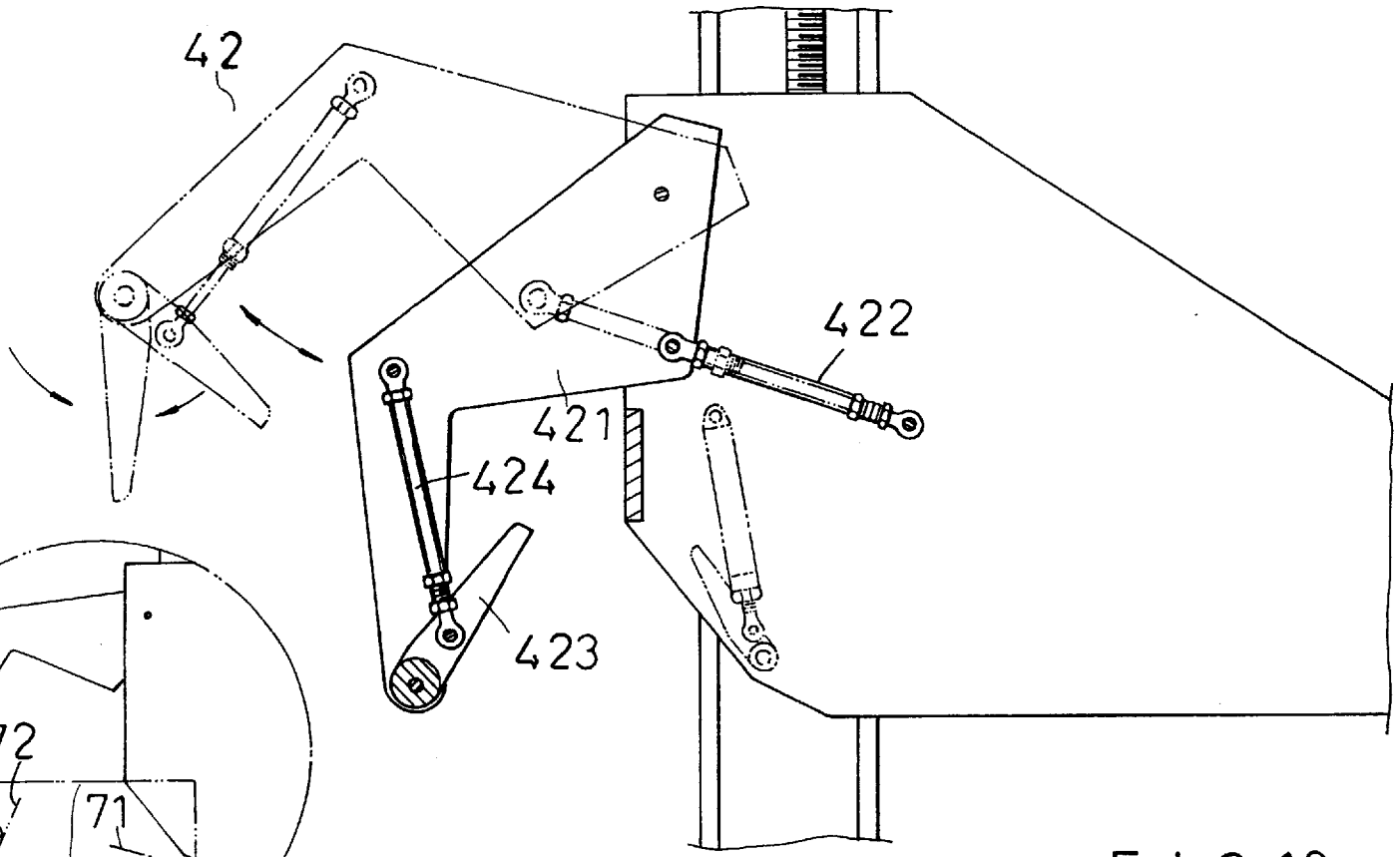
FIG. 19 is a side view of a second swing arm of second folding device in the present invention.
Figure 20:
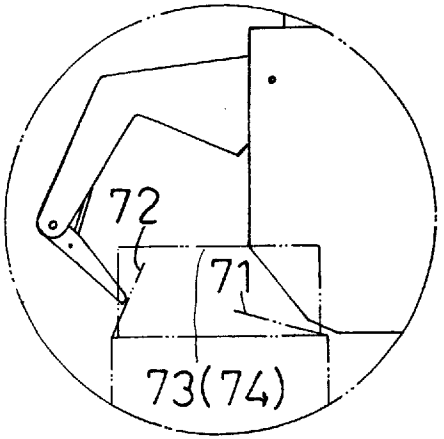
FIG. 20 is an operating condition of FIG. 18 in the present invention.

The second folding unit 4, as shown in FIGS. 18, 19 and 20, consists of a swing position means 41 and a swing pressing means 42. The swing position means 41 has a slanting support rod 411 fixed with the upper beam between the two front posts 25, 25, having its lower end fixed with a lower end of a sloped plate 412. A fourth air cylinder 413 is pivotally connected on an upper end of the sloped plate 412, and its piston rod moves a first swing arm 414 in a curved route. The swing pressing means 42 consists of a crank-shaped arm 421 pivotally connected on an upper end of the hollow interior 301 of the hollow case 30, and connected with a fifth air cylinder 422, which moves to adjust the revolving angle of the crank-shaped arm 421. A second swing arm 423 is pivotally connected with an end of the crank-shaped arm 421, moved to be adjusted in its moving angle by a sixth air cylinder 424 disposed on the crank-shaped arm 421.

Figure 21:
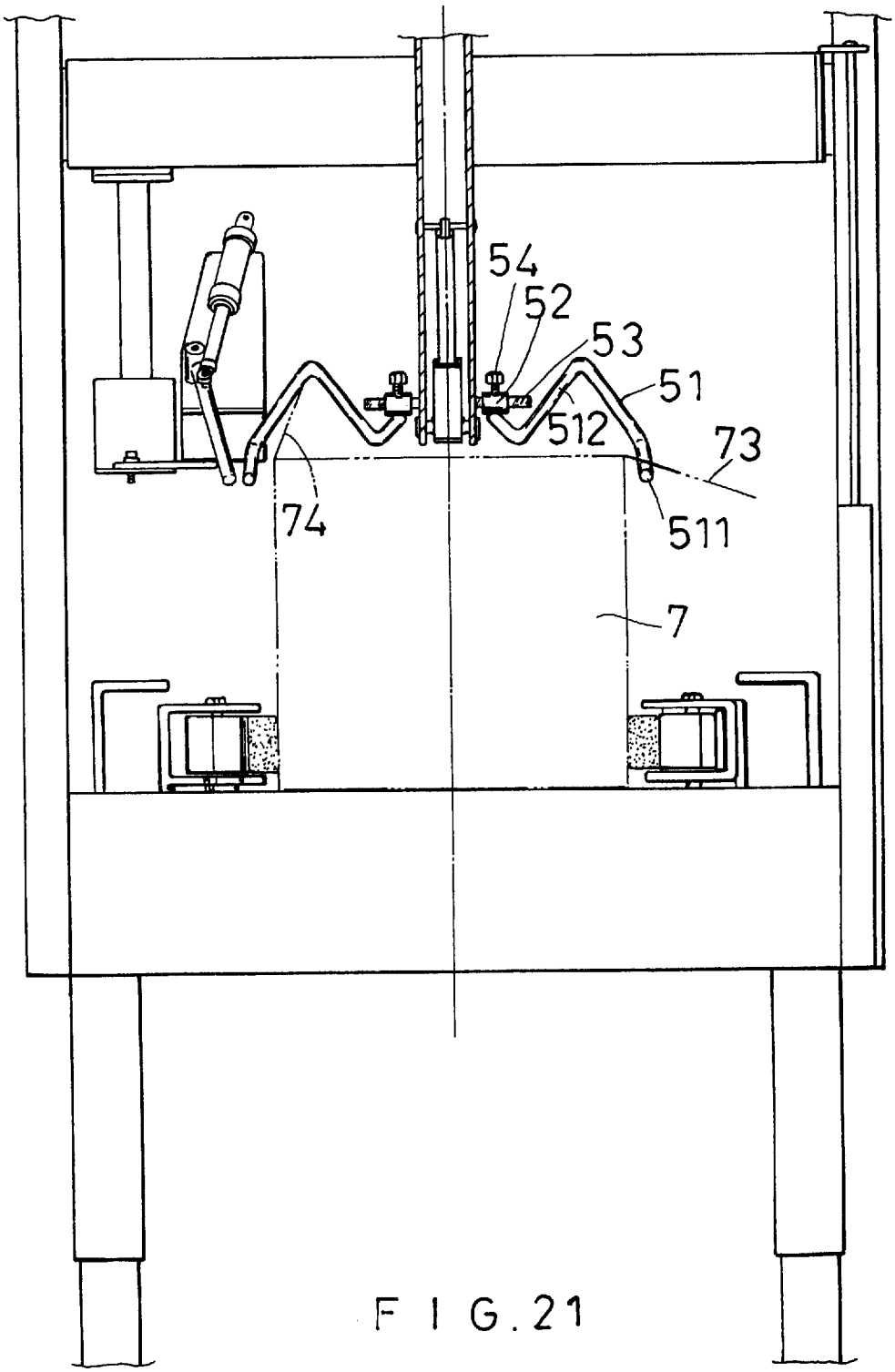
FIG. 21 is front view of a third folding device in the present invention.

The third folding unit 5 as shown in FIG. 21, has two opposite clamp guide rods 51, 51 each having an outer end 511 to move upward to fold two side flaps of a carton 73, 74, and a sloped pressing portion 512 for pressing gradually the two side flaps down inward, i.e. folding it down as the carton is moved on. An inner end of each clamp guide rod 51 is fixed with a sleeve 52 adjustably connected with a rod 53 with a screw 54 for adjusting each clamp guide rod 51 inward and outward.

Figure 22:
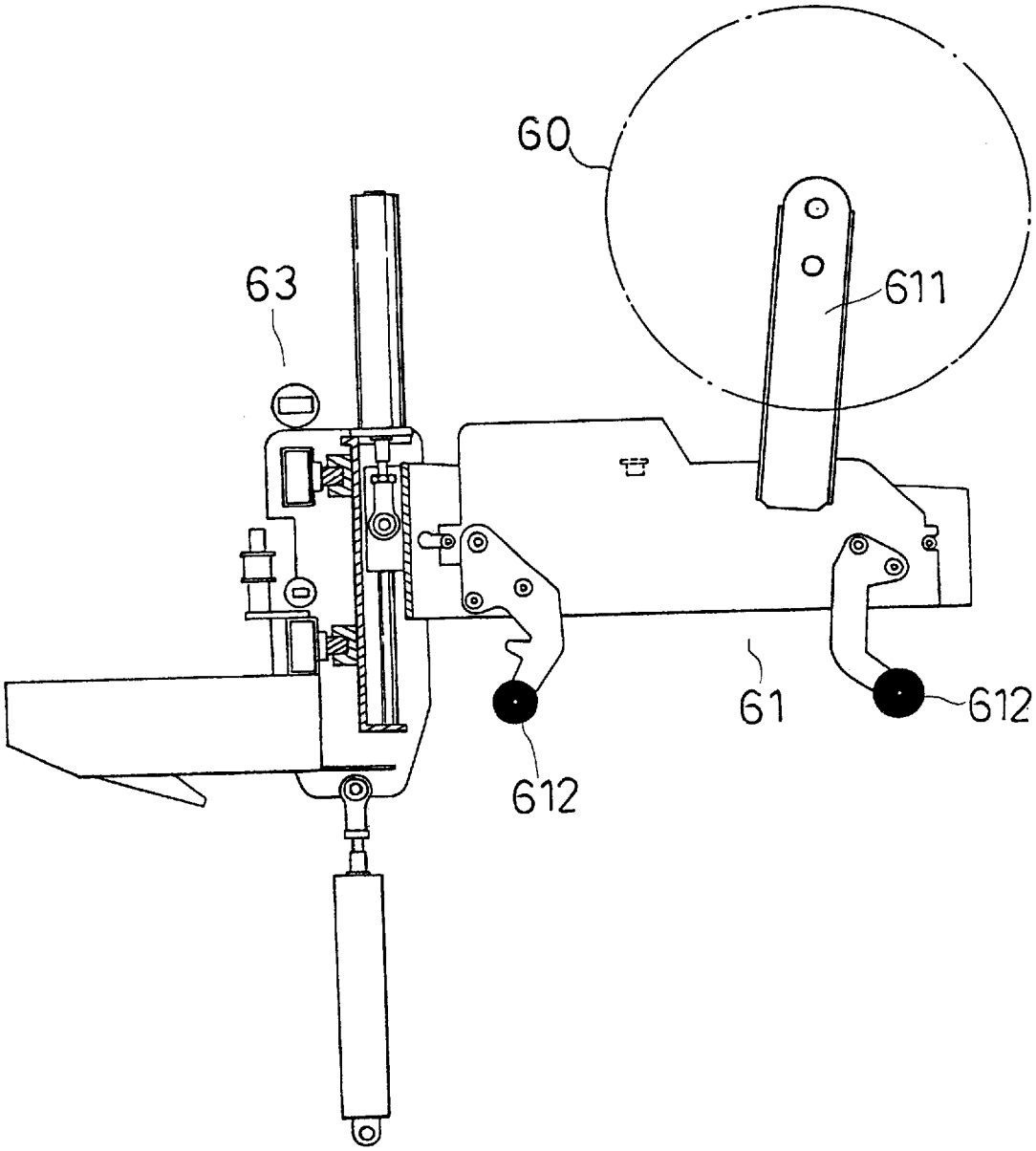
FIG. 22 is a side view of an upper base of a sealing device in the present invention; and, FIG. 23 is a side view of lower base of the sealing device in the present invention.
Figure 23:
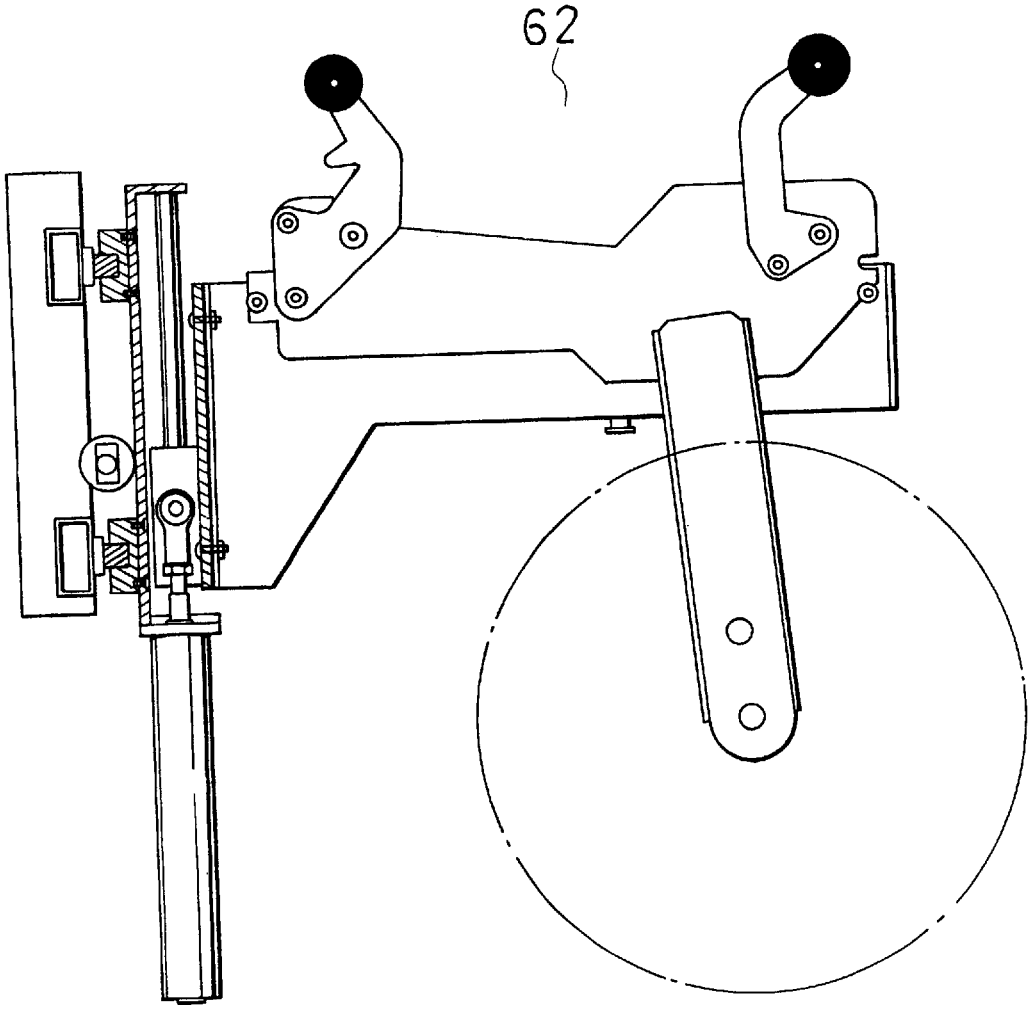

The sealing device 6, as shown in FIGS. 1, 22 and 23, includes two pairs of an upper and a lower base 61, 62 facing each other. The upper and the lower base 61, 62 respectively have a tape support frame 611, 621 for hanging a glue tape 60 thereon, a roller unit 612, 622 or spreading the tape 60 into a flat condition, and an adjusting unit 63 disposed on the upper and the lower base 61, 62 for adjusting the position of the two bases 61, 62 properly. After the tape 60 on a first pair of the two bases 61, 62 is used up, then the tape on a second pair of the two bases 61, 62 continues to be used without interruption.

Figure 9:
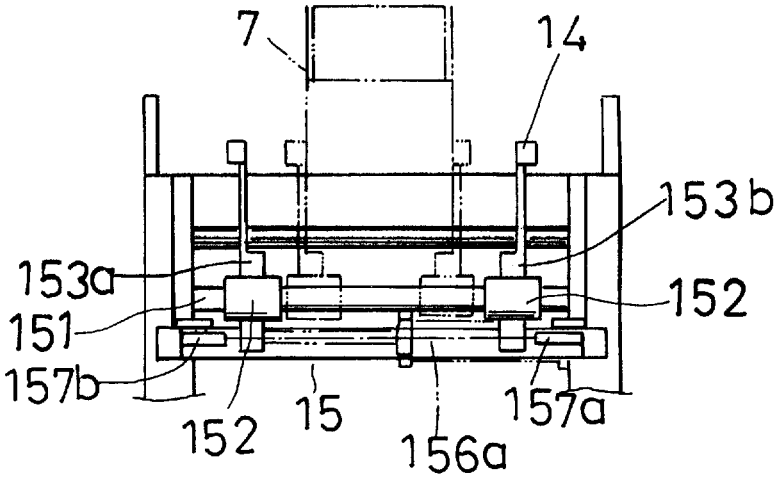
FIG. 9 is a front vies of the separator in the the present invention, showing it in a operating condition.
Figure 10:
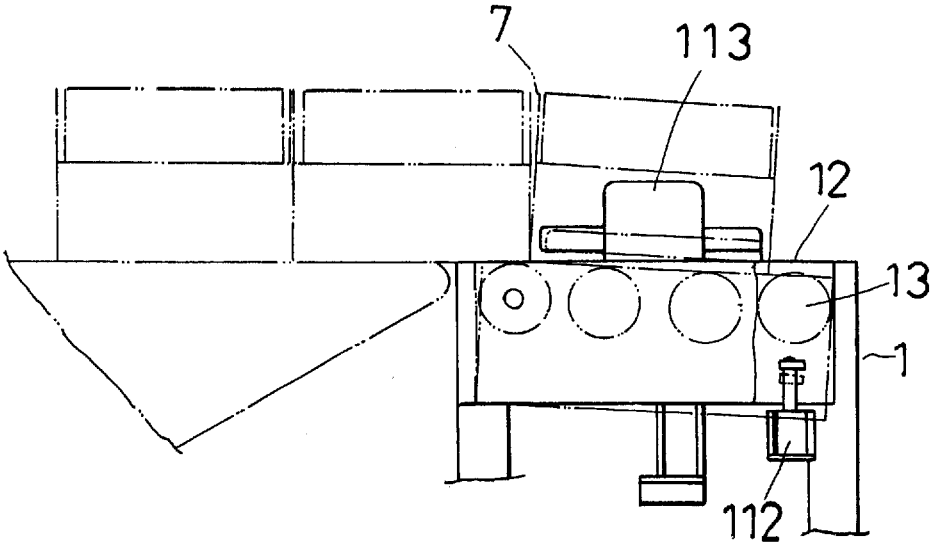
FIG. 10 is a side view of the separator in the present invention, showing it another operating condition.
Figure 12:
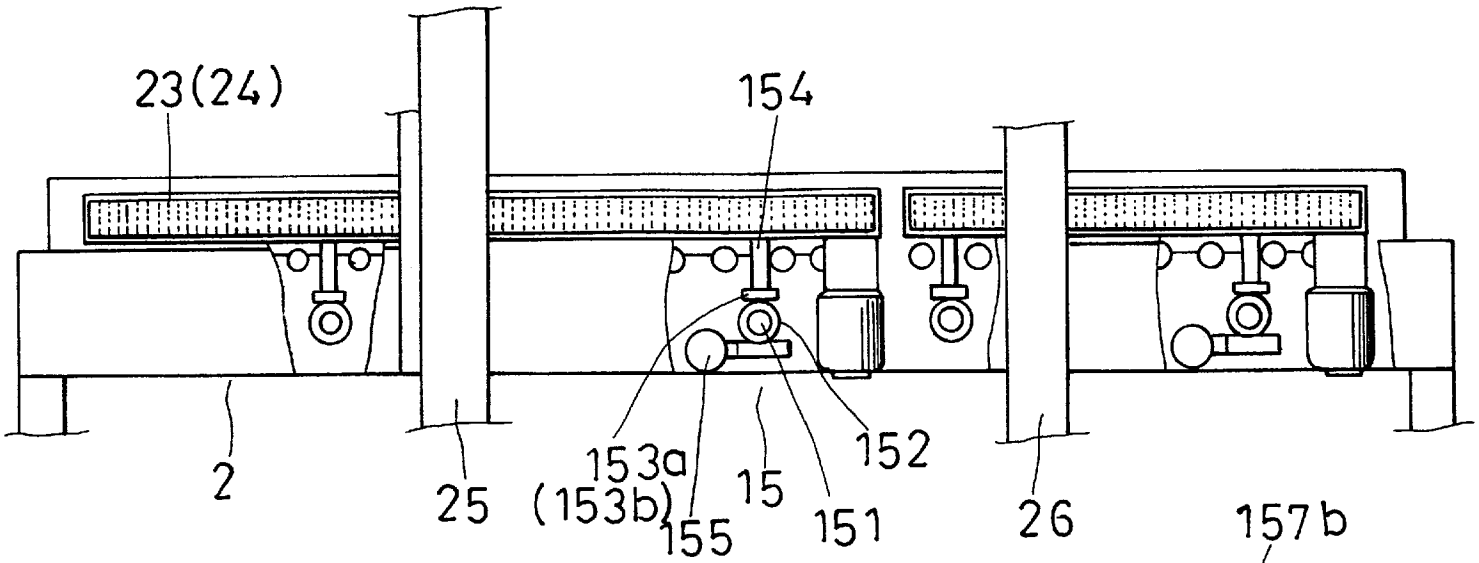
FIG. 12 is a side view of the conveyor in the present invention.
Figure 13:
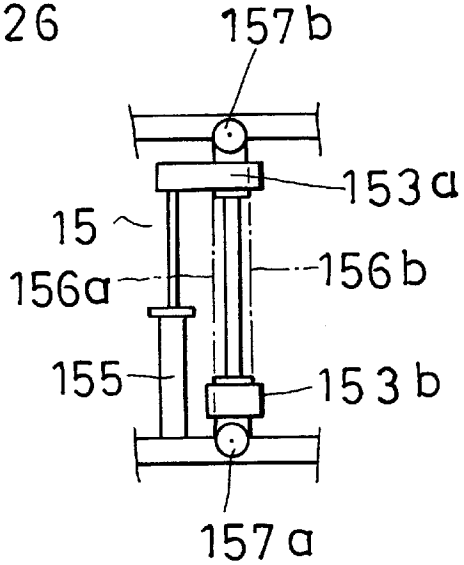
FIG. 13 is a partial enlarged figure of FIG. 11 in the present invention.
Figure 14:
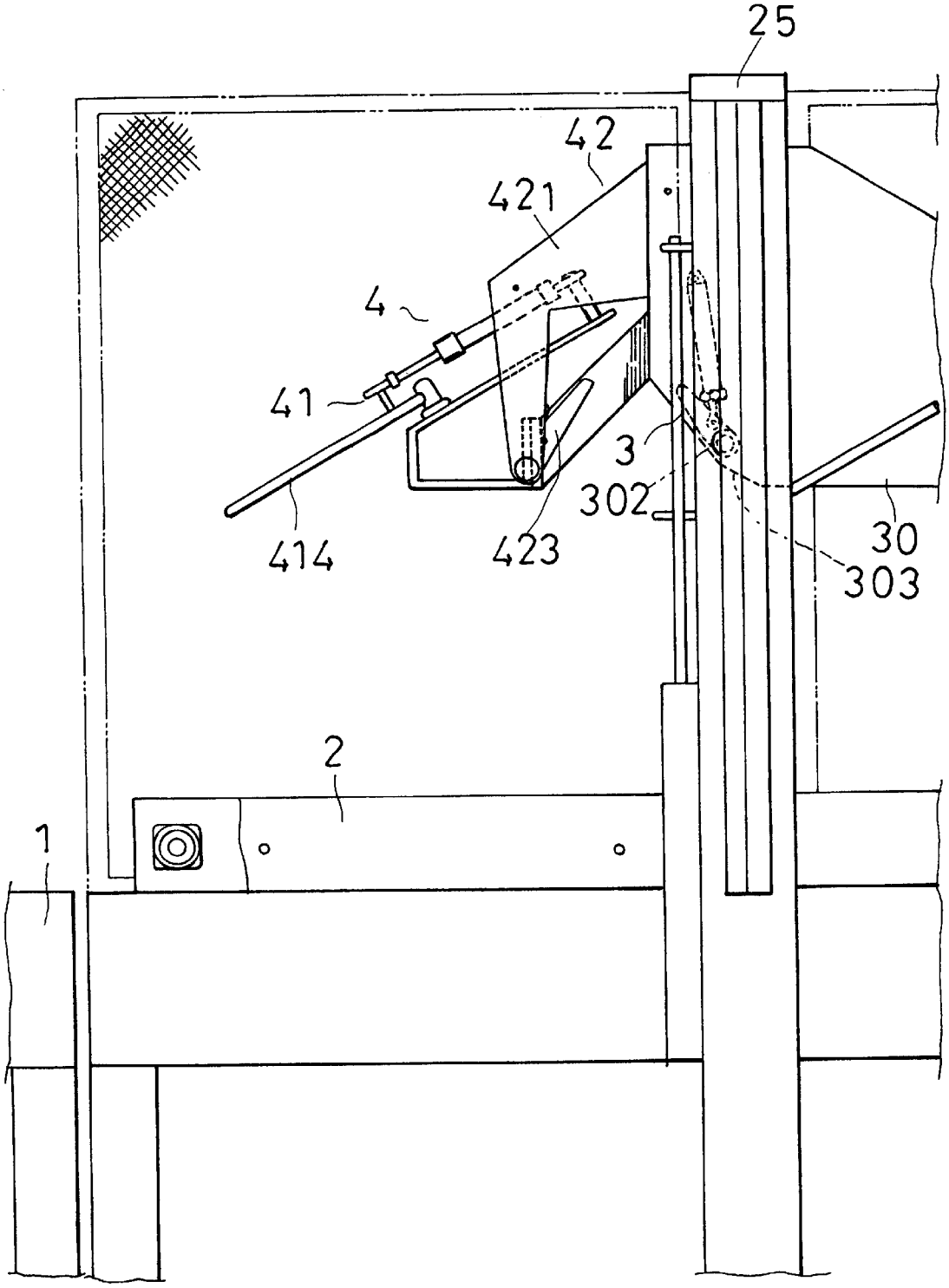
FIG. 14 is a side view of a second folding device in the present invention.
Figure 15:
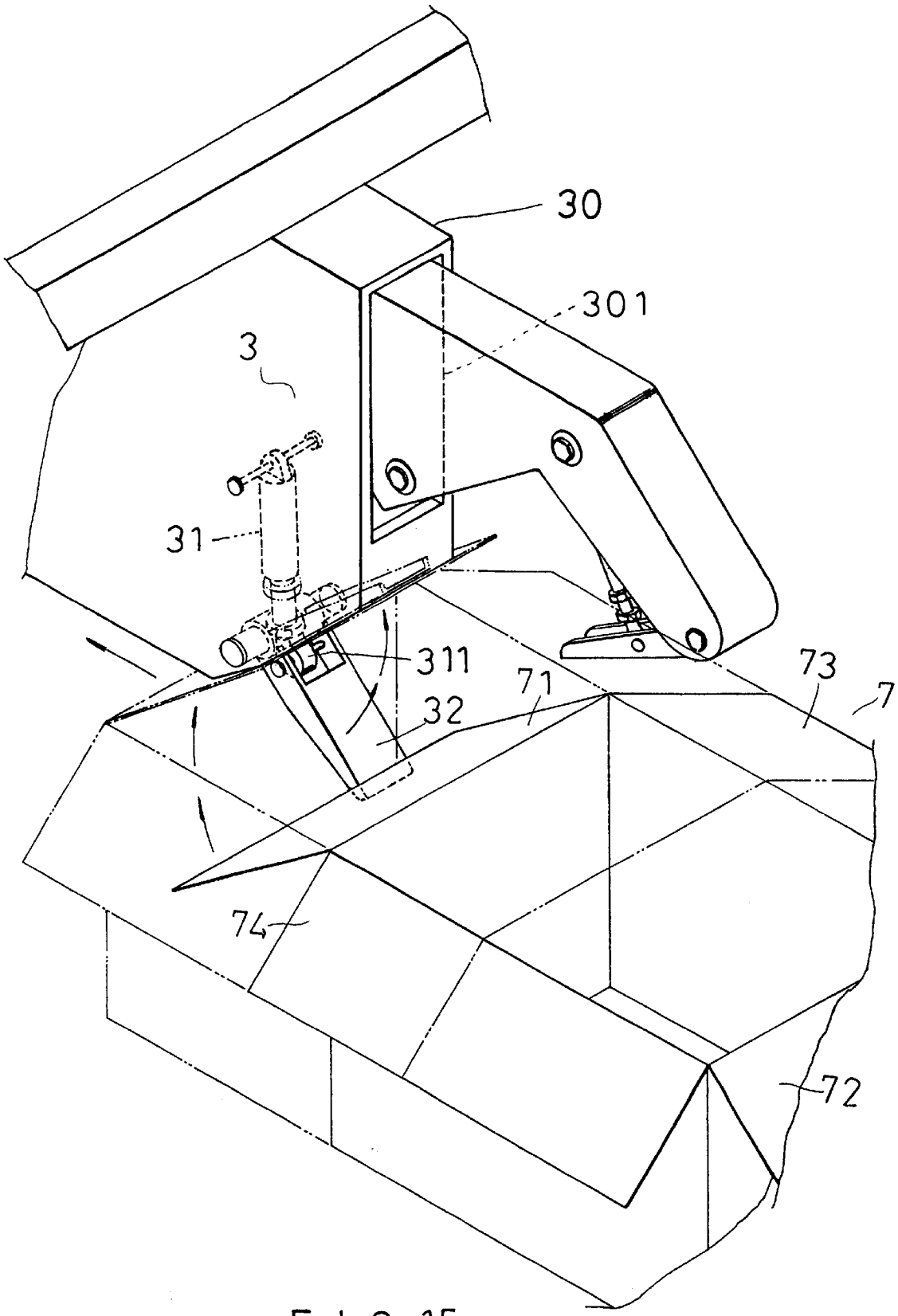
FIG. 15 is a perspective view of a first folding device in the present invention.
Figure 17:
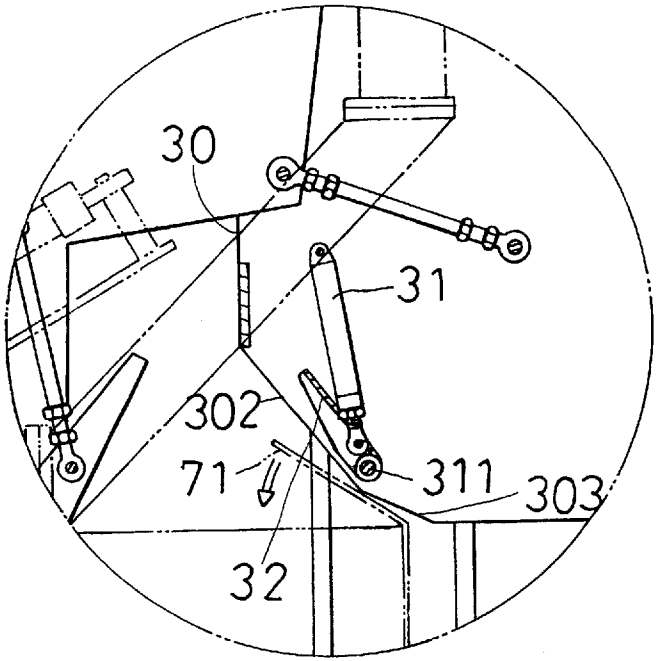
FIG. 17 is a perspective view of the first folding device in the present invention, showing it in another folding movement.
Figure 16:
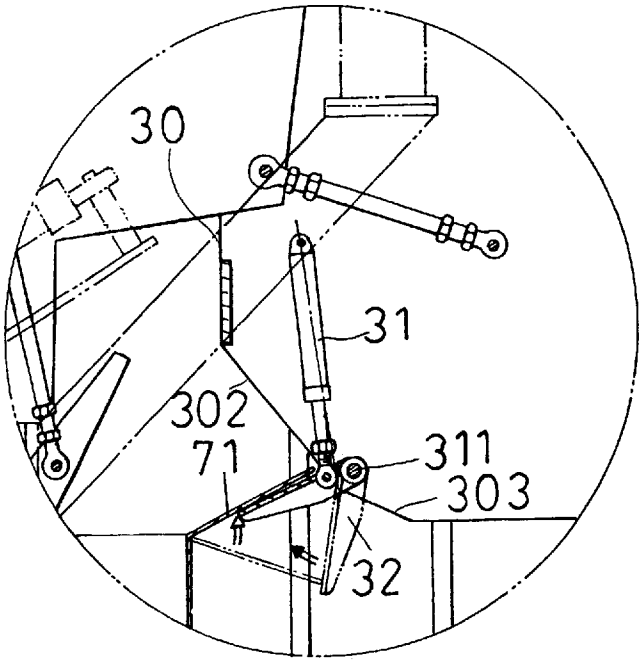
FIG. 16 is a perspective view of the first folding device in the present invention, showing it in a folding movement.

In operation process of the carton flap folding and sealing machine of the present invention, when a carton to be folded and sealed is placed on the separator 1, the reduction motor 131 rotates the rollers 13 to move forward the carton. Then the first sensor 201 senses a carton moving on the lift table 12, activating the second air cylinder 155 to move the chains 156*a*, 156*b* which then move the clamp strips 14, 14 to clamp the carton 7, correcting its position, as shown in FIGS. 9 and 10. Meanwhile, the first air cylinder 112 operates to let the lift table 12 slope down to a preset position, with the carton 7 on the lift table 12 also tilting to hamper other cartons on the conveyor 2 from advancing. There when the fourth sensor 204 senses a previous carton 7 finished in folding process and moving into the sealing device 6, the first air cylinder 112 of the separator 1 and the second air cylinder 155 receives command to operate again, moving the lift table 12 up and slackens the clamp strips 14, 14 to let the carton 7 to move into the conveyor 2 by means of the rollers 13 so as to permit a next carton 7 advance onto the separator 1 in position. Then the linear scale 16 measures the width of the carton 7 and notifies it to each folding unit.

When a carton moves on the conveyor 2, the second sensor 202 senses the carton 7 clamped by the clamp strips 23, 24 and then sends out data of its size to all the folding units 3, 4 and 5. Then the height of them are adjusted to a proper level for the swing plate 32 of the first folding unit 3 to raise up the front flap 71 from under. At this moment the third sensor 203 gets a signal of passing of the carton 7, and commands the first swing arm 414 of the swing position means 41 to swing up a rear flap 72 as the carton keeps on moving, and then the front flap 71 going to contact the sloped guide surface 302 and the sloped position surface 303 of the hollow case 30. Then the second swing arm 423 of the swing pressing means 42 presses the rear flap 72 down inward the carton 7. As the carton continues to move past the hollow case 30, the third folding device 5 is activated to fold up two side flaps 73, 74 with the clamp guide rods 51, 51 having the outer ends 511, 511 contacting and swinging up the two side flaps 73, 74 and then with the sloped pressing portions 512, 512 contacting and moving the side flaps 73, 74 completely down inward the carton 7 with their bent shape. Then the carton is moved in the sealing device 6, which has two pairs of the upper and the lower base 61, 62 to be operated alternately so that sealing process may not be interrupted by a tape used up. Because one pair of the upper and the lower base 61, 62 can take place of the other pair immediately in case its tape used up, without need of stopping the sealing device 6 to replace the tape 60.

While the preferred embodiment of the invention has been described above, it will be recognized and understood that various modifications may be made therein and the appended claims are intended to cover all such modifications which may fall within the spirit and scope of the invention.

What is claimed is:

1. A carton flap folding and sealing machine comprising a separator, a conveyor, a first folding device, a second folding device, a third folding device, and a sealing device combined together;

said separator having a position stand, a lift table, a roller unit, two clamp strips, a transmitting device and a linear scale combined together;

said position stand having casters at bottom ends, a first air cylinder fixed at a proper location for controlling said lift table in its movement, a sensor fixed on an upper side edge, several roller units fixed between two opposite walls of said lift table, a reduction motor fixed at a proper location to move said roller units, said two clamp strips fixed on said lift table and moved inward and outward by said transmitting device;

said transmitting device having two slide bars between two opposite walls below said roller units, a slide block respectively fixed on two ends of each said slide bar, a first and a second fix plate respectively connected on said two slide blocks, an upright support rod respectively fixed with said first and said second fix plate and between two roller units and having an upper end fixed firmly with each said clamp strip, a second air cylinder fixed on a side wall of said lift table and having its piston rod end respectively fixed with said first and said second fix plate, a first chain having its one end fixed on an outer side of said first fix plate and extending around a first guide wheel and having it through to an other side of the first fix plate and then having its other end fixed on an inner side of said second fix plate, a second chain having its one end fixed on an inner side of said first fix plate, a cover closing on an outer side of said transmitting device, said first and said second fix plate moving nearer to or farther from each other by means of said two chains controlled by operation of said second air cylinder, and said linear scale fixed on a side wall of said lift table and beside said transmitting device and between said two fix plates for measuring width of a carton;

said conveyor having castors at bottom ends, a plurality of rollers, two opposite clamp strips located on said rollers in relative locations to said folding devices, two front opposite posts and two rear opposite posts disposed to stand at two opposite sides of said conveyor, said first folding device located between said front posts, said second folding device located between said rear posts, a first sensor, a second sensor, a third sensor, a fourth sensor, a fifth sensor and a sixth sensor each fixed on a side edge of said conveyor and respectively facing said first folding device, said second folding device and said third folding device;

said first folding device having a hollow case fixed under a horizontal beam fixed between upper ends of said two front posts, said hollow case having a sloped guide surface on a front side and a sloped position surface of a large curve extending further down from said guide surface, said hollow case having a hollow interior, a third air cylinder fixed in said hollow interior at a lower portion, said third air cylinder having its piston rod end connected with a revolving head, said revolving head connected with a swing plate for swinging a front flap of a carton;

said second folding device having a swing position means and a swing pressing means, said swing position means having a slanting support rod fixed on said upper beam of said front posts and extending slantingly down, a sloped plate fixed with a lower end of said slanting support rod, a fourth air cylinder pivotally disposed on said sloped plate and having its piston rod end connected with a first swing arm to let said first swing arm to swing in a curved route, said swing pressing means having a crank-shaped arm pivotally fixed on an upper end of said hollow interior of said hollow case, a fifth air cylinder pivotally fixed in said hollow case and having its piston rod end pivotally connected with said crank-shaped arm to adjust a swing angle of said crank-shaped arm, a second swing arm having its inner end pivotally connected with an outer end of said crank-shaped arm and swung to change its angle by a sixth air cylinder pivotally connected on said crank-shaped arm having its piston rod end pivotally connected with an intermediate portion of said second swing arm;

said third folding device having two opposite clamp guide rods adjustable in moving nearer to or farther from each other to swing upward two side flaps of a carton and folding inward by its sloped pressing portion as the carton moves forward, said two clamp guide rods respectively having its inner end fixed with a sleeve fitted around a rod, a screw respectively screwing tightly each said sleeve for handling said same rods to move nearer to or farther from each other;

said sealing device having two pairs of an upper base and a lower base facing each other, said upper base and said lower base respectively having a tape support frame for hanging a glue tape thereon, and a roller unit for spreading said tape in a flat condition, and a adjusting unit respectively fixed on said upper base and said lower base so as to adjust the position of said two bases, one of said two tapes immediately taking place of the other tape in case the latter is used up without in interruption of sealing operation.

* * * * *